US006110060A

United States Patent [19]

Spoto

[11] Patent Number: 6,110,060

[45] Date of Patent: Aug. 29, 2000

[54] ADJUSTABLE HEIGHT GOLF TEE

[76] Inventor: Louis Michael Spoto, 318 Sharon Dr., Sleepy Hollow, Ill. 60118

[21] Appl. No.: 09/024,864

[22] Filed: Feb. 17, 1998

Related U.S. Application Data

[63] Continuation-in-part of application No. 08/867,270, Jun. 2, 1997, abandoned.

[51] Int. Cl.[7] ..... A63B 57/00

[52] U.S. Cl. ..... 473/396; 473/398

[58] Field of Search ..... 473/387–403

[56] References Cited

U.S. PATENT DOCUMENTS

| | | | |
|---|---|---|---|
| D. 306,751 | 3/1990 | Orton . | |
| 1,554,321 | 9/1925 | Banigan | 473/398 |
| 1,564,212 | 12/1925 | Decker | 473/398 |
| 1,625,911 | 4/1927 | Richards . | |
| 2,079,387 | 5/1937 | Stickmiller | 473/398 |
| 2,626,150 | 1/1953 | Karns | 473/396 |
| 2,805,071 | 9/1957 | Kaplan | 473/398 |
| 3,114,557 | 12/1963 | Cabot . | |
| 3,203,700 | 8/1965 | Antonious . | |
| 3,408,079 | 10/1968 | Kirikos . | |
| 3,467,390 | 9/1969 | Gardiner . | |
| 3,765,683 | 10/1973 | Landry . | |
| 3,889,946 | 6/1975 | Setecka . | |
| 3,975,024 | 8/1976 | Stephan . | |
| 4,260,157 | 4/1981 | Jones et al. . | |
| 4,516,780 | 5/1985 | Tabet . | |
| 5,052,689 | 10/1991 | Lettrich . | |
| 5,156,403 | 10/1992 | Martino | 473/396 |
| 5,248,144 | 9/1993 | Ullerich . | |

*Primary Examiner*—Steve Wong
*Attorney, Agent, or Firm*—Swanson & Bratschun LLC

[57] ABSTRACT

The first aspect of the present invention is an adjustable height golf tee. The adjustable height golf tee consists of an elongated ball support having a sidewall defining a hollow interior in a proximal and a distal end. The distal end defines a ball support surface. A plurality of collapsible ties have a proximal end and a distal end and have the proximal end attached to and extending from the proximal end of the ball support. The collapsible ties are configured to support the ball support in an upright orientation with the distal end of the ties engaging a horizontal surface and to collapse into the hollow interior of the ball support upon application of a select axial load to the ball support in a direction toward the proximal end of the ball support. Preferably, an anchor is attached to the distal end of the ties with the anchor having a diameter equivalent greater than an outer diameter equivalent of the ball support. The ball support, the ties and the anchor are preferably integrally formed from a single piece of elastomer.

13 Claims, 5 Drawing Sheets

ADJUSTABLE HEIGHT GOLF TEE

RELATED APPLICATIONS

This application is a continuation in part of U.S. patent application Ser. No. 08/867,270, filed Jun. 2, 1997, entitled "Adjustable Height Golf Tee" now abandoned.

BACKGROUND OF THE INVENTION

Technical Field

The present invention relates in general to a golf tee, and in particular to an adjustable height golf tee for use with a driving range mat.

Background Art

The game of golf is played on a golf course which consists of a series of holes, typically 9 or 18, laid out on an area of land. Each hole includes a tee from which a player initiates play and a putting green of short trimmed grass surrounding a cup, with the tee and the green separated by a select distance typically occupied by a grass fairway. The fairway may be straight or curved and may include a number of obstacles or hazards such as trees, sand traps, ponds, creeks and the like. The object of the game is for a player using a club to knock a ball from the tee box to the cup in as few shots as possible.

The game is played with a number of clubs which are broadly divided into irons and woods and which are variously weighted, pitched and designed to accomplish shots of different distance and height. For example, wood clubs are used to drive the ball relatively long distances, such as, for example, in excess of 180 yards, with relatively little loft. A pitching iron club is used to drive the ball accurately over relatively short distances, for example, less than approximately 100 yards with a relatively high loft in order to avoid obstacles on the playing surface and to provide for minimal travel of the ball once it lands on the intended portion of the playing surface, typically the green.

When play on a hole is initiated a player is allowed to place the ball upon a tee which elevates the ball a select distance above the ground. The height at which the player elevates the ball over the ground is a function, among other things, of the club the player wishes to use to initiate play. For relatively long holes, players will use woods to drive the ball from the tee. Because woods have relatively little pitch in order to maximize the distance (as opposed to the height) the ball will travel, players typically tee up the ball relatively high when using woods. For shorter holes, typically under 180 yards, players generally will use irons. Irons tend to have greater pitch to the striking surface and as a result, players tee up the ball relatively low, with the height of the tee decreasing with increasing pitch of the iron.

In order to gain repetitive practice on their golf strokes, golfers typically utilize a driving range. A driving range is a facility which consists of an elongated area from which golfers drive balls into an open field. Because of the repetition which golfers drive balls from the driving areas at driving ranges, it is not feasible to utilize a standard grass playing surface in most instances. Particularly at commercial driving ranges, the driving areas would quickly fall into disrepair because of the frequency and repetition of use. Thus, the driving area typically utilizes an artificial hitting surface overlying a rigid planar platform such as a concrete slab or hard pan.

The artificial hitting surface typically includes a ball support which is intended to simulate a wooden or plastic golf tee. The ball supports used at driving ranges are typically integrally molded rubber tubes extending from a planar base. The artificial hitting surface has an aperture through which the tube can be inserted from the bottom of the artificial surface and the base is then held in abutment with the underlying platform by the bottom of the artificial hitting surface. One drawback to the use of the rubberized tubing ball supports is that the height the ball is maintained off the playing surface cannot be easily altered. While different lengths of rubberized tubing can be provided, it is cumbersome to replace the existing ball support in a given artificial surface mat. In order to change a ball support for one having a different length tube, the mat must be lifted from the ground to access its underside so that the current ball support can be removed and replaced with the select ball support. In addition to being time consuming and awkward for the golfer, the mat is often dirty and soiled, leading to the soiling of the golfer.

An additional disadvantage of conventional driving range tee systems is that, even if the golfer goes through the trouble of changing the height of the tee on the artificial surface mat, the ball support must be replaced with a different additional ball support having a different length when the golfer desires to play with a different club. Thus, the cumbersome replacement must be repeated each time the player selects a different club. Furthermore, if a number of different height ball supports are to be provided, the golf range operator must stock a large number of replacement tees for the golfer's selection. In addition, replacing tees keeps players on the practice tees longer, depriving other golfers of the opportunity of using the practice areas and depriving the golf range operator of revenue of the additional players.

When playing on natural turf, players typically control the height the ball by pushing the tee into the earth a desired distance. Experienced golfers, such as professionals, know by their considerable experience precisely how far they want to insert a tee into the ground when driving a ball with a select club. Less experienced players have a difficult time precisely adjusting the golf tee and, particularly where the ground is soft or otherwise relatively unstable, may have a difficult time maintaining the ball at a particular select height.

The prior art contains a number of golf tee supports and adjustment mechanisms to address this problem when playing off of natural turf. For example, Lettrich, U.S. Pat. No. 5,052,689, teaches a golf tee support structure including a tubular support which extends from a flat base. The tubular support is configured to either receive a tee or a ball without the use of the tee and includes plurality of annular grooves spaced lengthwise in its outer periphery to facilitate cutting the tubular member to whatever height the golfer desires. The inner periphery of the tubular member may include a number of radially projecting annular extending ribs to retain the shank of a golf tee. While this device is suitable for providing a consistent elevation of a golf ball over a penetrable surface such as dirt or turf, it is of no use on an impenetrable rigid surface such as one might encounter under a driving range mat. In addition, adjustment of the height of the ball above the surface cannot be readily accomplished, but requires disassembly of the tee and support and cutting of the support. Should a player desire to change the elevation of the ball, the player must produce a new, uncut support to do so.

Cabot, U.S. Pat. No. 3,114,557, discloses a golf tee, the shank of which is provided with longitudinally extended lugs, while an annular collar is provided with notches extending radially outwardly from the central bore and adapted to be aligned with the lugs so as to permit the collar to be raised or lowered, at the discretion of the golfer, then turned to lock in position.

Antonious, U.S. Pat. No. 3,203,700 discloses a tee, the shank of which is provided with radially extending notches and a metal clip adapted to be engaged with the notches at whatever height is desirable for the golfer. The function of establishing the height of the tee above the ground is provided by the clip being inserted in a select pair of notches on the shank.

Kirikos, U.S. Pat. No. 3,408,079 relates to a golf tee having a vertically adjustable ground engaging stop member having a square hole adapted to slidably engage the shank of the tee. To position the height of the adjustment member, corner portions of the shank are removed, permitting the annular plate to be adjusted vertically and then rotated to lock in place along the shank.

Each of the structures disclosed in the '557 patent, the '700 patent and the '079 patent have an advantage over the Lettrich patent in that they can be readjusted as desired by the golfer. However, each of these structures requires relatively complicated manipulation by the user in order to change the height. In addition, the devices require a number of parts which must meet relatively strict tolerances, making them relatively expensive to produce and assemble. Furthermore, none of these structures is suitable for use over an impenetrable surface such as is typically encountered in a golf driving range.

Ullerich, U.S. Pat. No. 5,248,144 is directed to a golf tee for use on a driving range that includes a base having an internally threaded cylindrical tube orthogonally mounted to the base, with the golf tee having an externally threaded body adjustably mounted within the tube. An upper wall of the golf tee is formed with a concave surface to accommodate a golf ball thereon. The height which the golf tee elevates a ball above the ground can be varied by grasping and rotating the tee relative to the base. While Ullerich provides a tee with some degree of adjustability for use at a driving range, it has a number of serious drawbacks. First, the tee and base must be manufactured to relatively high tolerances so that they will properly engage and function together. This makes their fabrication relatively expensive. In addition, assembly requires threading of the tee into the base. This type of assembly promotes repetitive motion injuries in assemblers and, therefore, should be avoided. Furthermore, in use it is difficult to grip the tee so as to rotate it relative to the base. It is also awkward to bend over and rotate the tee when installed in a driving range mat. In order to effect significant height changes, the tee must be rotated a considerable amount which is a painstaking and slow process. Finally, because there is nothing fixing the base against rotation, the base is likely to slip between the mat and the underlying surface during twisting of the tee making adjustment of the height particularly difficult, especially when the tee, mat and underlying surface are damp.

Horton, Des. 306,715 discloses an adjustable golf tee comprising a base which telescopingly receives a tee portion orthogonally to the base, the tee portion being capable of being raised and lowered relative to the base by pushing the tee into or pulling the tee from the base. However, Horton teaches an elevated base which would not be suitable for use with a driving range mat. In addition, Horton requires a flange/shoulder engagement between the base and the tee which could render manufacture and assembly difficult.

Decker, U.S. Pat. No. 1,564,212 teaches a golf tee having a broad base on which a ball supporting post extends. With the ball supporting post extended, a ball is supported a first select distance above a horizontal surface. The post can also be folded into the base to provides a second select distance less than the first select distance above the horizontal surface. While this does provide a golf tee made of a single piece of material that is adjustable as to the height of the elevation of the ball, the tee only has two positions, the post fully extended or the post fully retracted. Moreover, the dome shape of the support base makes the tee unsuitable for use with a driving range mat.

Kaplan, U.S. Pat. No. 2,805,071 discloses a dome-shaped base having a post extending vertically therefrom. The dome-shaped base can be collapsed to lower the amount of elevation of the golf ball. As with Decker, Kaplan only provides two possible elevations of the golf ball. Also, the dome of Kaplan is not suitable for use with a driving range mat.

Martino, U.S. Pat. No. 5,156,403 teaches an adjustable height golf tee featuring a base having an enlarged flange at its bottom and a post extending vertically therefrom, the post being sized to be fit within a hole in a driving range mat. A tee is received in an axial hole in the post and frictionally engaged within this hole to support a golf ball at a select height. The bottom of the tee includes a flange to prevent removal of the tee from the base during use. Martino, like Ullerich suffers the drawback of being made from two pieces, which increases manufacturing and handling costs.

The present invention is directed toward overcoming one or more of the problems discussed above.

SUMMARY OF THE INVENTION

The first aspect of the present invention is an adjustable height golf tee. The adjustable height golf tee consists of an elongated ball support having a sidewall defining a hollow interior and a proximal and a distal end. The distal end defines a ball support surface. A plurality of collapsible ties have a proximal end and a distal end with the proximal end attached to and extending from the proximal end of the ball support. The collapsible ties are configured to support the ball support in an upright orientation with the distal end of the ties engaging a horizontal surface and to collapse into the hollow interior of the ball support upon application of a select axial load to the ball support in a direction toward the proximal end of the ball support. Preferably, an anchor is attached to the distal end of the ties with the anchor having a diameter equivalent greater than an outer diameter equivalent of the ball support. The ball support, the ties and the anchor are preferably integrally formed from a single piece of elastomer.

Another embodiment of the present invention is an adjustable height golf tee in combination with the driving range mat. The mat has a top and a bottom surface separated by a select depth. An aperture of a select equivalent diameter extends between the top and bottom surfaces of the mat. The adjustable height golf tee consists of an elongated ball support having an external surface with a cross-section configured and dimensioned to form an interference fit with the mat aperture. The ball support is thereby extendable and retractable relative to the top surface of the mat and is maintained at a select extended position by the interference fit. An anchor is provided adjacent the bottom surface of the mat, and is fixed against withdrawal through the aperture of the mat. A collapsible tie is attached at a proximal end to the ball support and at a distal end to the anchor to maintain the ball support within the aperture during use. The support preferably comprises a first hollow lengthwise section received in the aperture having the external lengthwise surface with the cross-section configured in dimensions to form an interference fit with the mat aperture. A second lengthwise section extends from the first lengthwise section above the top surface of the mat. The second lengthwise section has a parabolic sidewall between the first lengthwise section and a ball engaging end. The collapsible tie is configured to fold into the hollow interior of the ball support as the ball support is retracted relative to the top surface of the mat.

DETAILED DESCRIPTION OF THE PREFERRED EMBODIMENT

Figure 1:
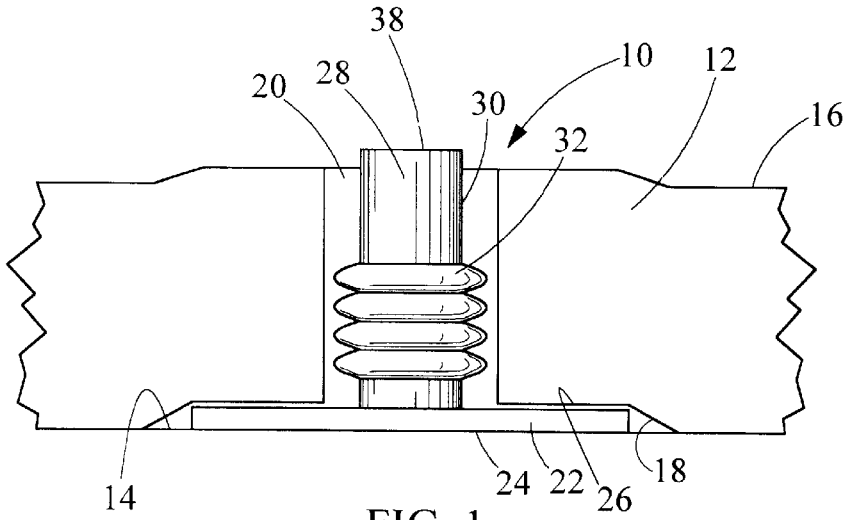
FIG. 1 is an elevational view of a first embodiment of an adjustable golf tee of the present invention disposed in a golf mat aperture with its height adjustment portion in a contracted position.

A first embodiment of an adjustable height golf tee 10 in accordance with the present invention is shown in operative engagement with a driving range mat 12 in FIG. 1. The driving mat 12 overlies a rigid planar surface 14 which may be, for example, a concrete slab, asphalt or highly compacted soil (i.e., hard pan). In general, the rigid planar surface is impenetrable. The mat 12 can be any suitable artificial surface such as a carpet made of natural or synthetic fibers or an artificial grass surface such as ASTROTURF brand artificial grass available from the Astroturf Corporation. The driving range mat 12 has an upper surface 16 and a lower surface 18 separated by a select distance and an aperture 20 of a select diameter extending between the upper surface 16 and the lower surface 14. In the preferred embodiment, the aperture 20 is a circular cross-section, although it may have any shape cross-section provided it has sufficient area to receive a driving range golf tee.

The adjustable height golf tee 10 of the present invention comprises a base 22 having a planar bottom 24 and a top surface 26. The base 22 is of a diameter significantly greater than the diameter of the aperture 20 so that with the adjustable height golf tee 10 disposing the operative position illustrated in FIG. 1, the adjustable height golf tee 10 cannot be removed from the aperture 20 from the top of the mat 12. While in the preferred embodiment the base 22 is circular, it can be square or any other desired shape, with the only provision being that the width (or diameter equivalent) be significantly greater than the diameter of the aperture 20.

The tube 28 extends from the top surface 26 of the base normal to the planar bottom 24 of the base 22. The tube is hollow and is formed by a sidewall 30 including an adjustable height portion 32. As illustrated in FIG. 1, the adjustable height portion 32 is an articulated portion of the sidewall. Alternatively, the adjustable height portion 32 could be an integral overlapping fold 34 (see the second embodiment illustrated in FIGS. 3 and 4) or a plurality of telescoping folds 36 (see the third embodiment illustrated in FIGS. 5 and 6). FIGS. 1–6 are very similar in nature, and identical reference numerals are used to identify like parts. At the distal end of the tube 28 is a ball support 38. In the embodiment as illustrated in FIG. 1, the ball support 38 is simply the open distal end of the sidewall 30.

Figure 2:
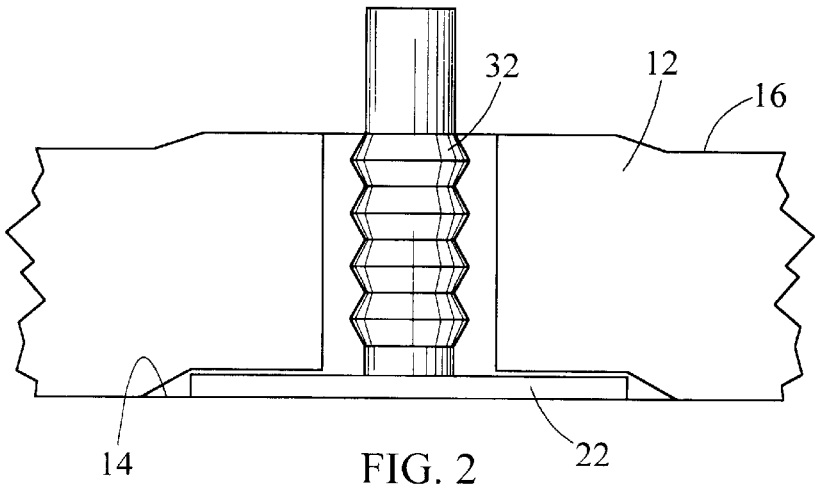
FIG. 2 is an elevational view of the adjustable golf tee of FIG. 1 with its adjustable height portion in an extended position.
Figure 3:
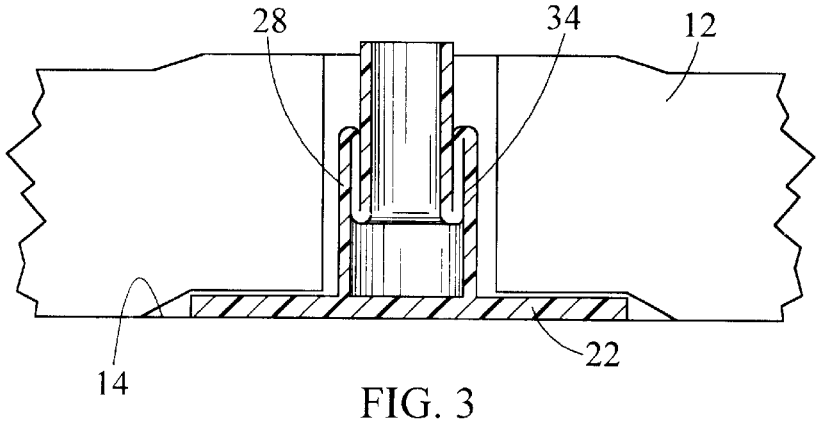
FIG. 3 is an elevational cross-section of a second embodiment of an adjustable golf tee with the adjustable height portion comprising an overlapping fold shown in the contracted position.

As illustrated in FIG. 1, with the adjustable height portion 32 in a retracted position, the ball support 38 extends only a slight distance above the top surface 16 of the mat 12. As seen in FIG. 2, with the height adjustment portion 32 in its extended position, the ball support 38 is a much greater distance off of the top surface 16 of the mat 12. The adjustable height portion 32 can be adjusted to a large number of increased heights between the extended position illustrated in FIG. 2 and the compacted position illustrated in FIG. 2. Significantly, as illustrated in FIGS. 1 and 2, in both the compacted and the extended positions, the adjustable height portion 32 of the sidewall 30 lies within the aperture 20. Stated another way, the distance between the planar bottom 24 and the distal end of the extendable portion 32 in both a contracted and an extended position is less than the depth of the driving range mat 12. However, it is within the scope of the invention for the adjustable height portion 32 to extend beyond the top surface of the mat 16, although this configuration may lack some of the advantages of the preferred embodiment.

In the embodiment illustrated in FIGS. 1 and 2, the base 22, the sidewall 30 (including the ball support 38) are integrally formed from a single piece. This piece may be molded from any suitable plastic which will permit a large number of repeated extensions and contractions of the adjustable height portion 32 without failure. Those skilled in the art will recognize that there are many synthetic plastics suitable for this purpose. One particular advantage of the integral single piece construction is that it can be manufactured very inexpensively using conventional manufacturing techniques. Virtually all handling and assembly of the piece is eliminated.

Figure 4:
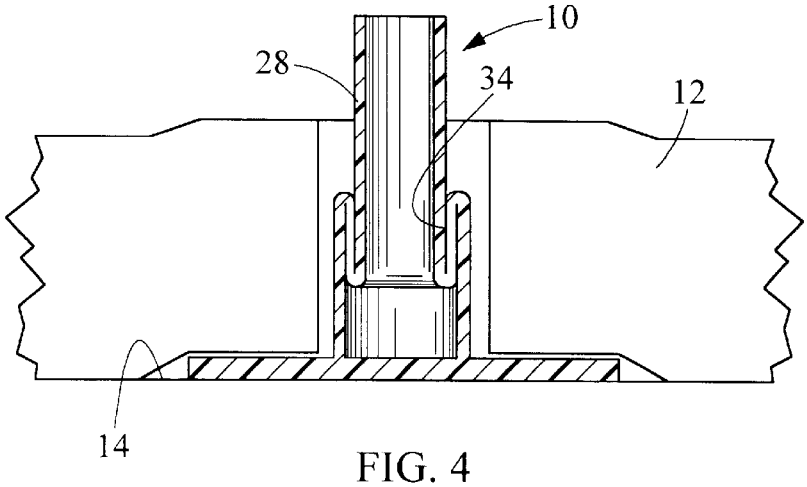
FIG. 4. is an elevational cross-section of the adjustable golf tee of FIG. 3 with the adjustable height portion shown in the extended position.
Figure 5:
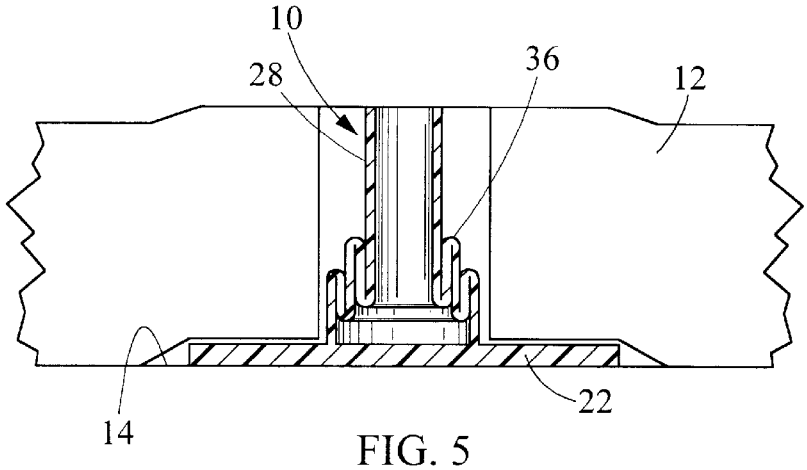
FIG. 5 is an elevational cross-section of an embodiment of an adjustable golf tee with the adjustable height portion comprising a plurality of telescoping folds shown in the contracted position.
Figure 6:
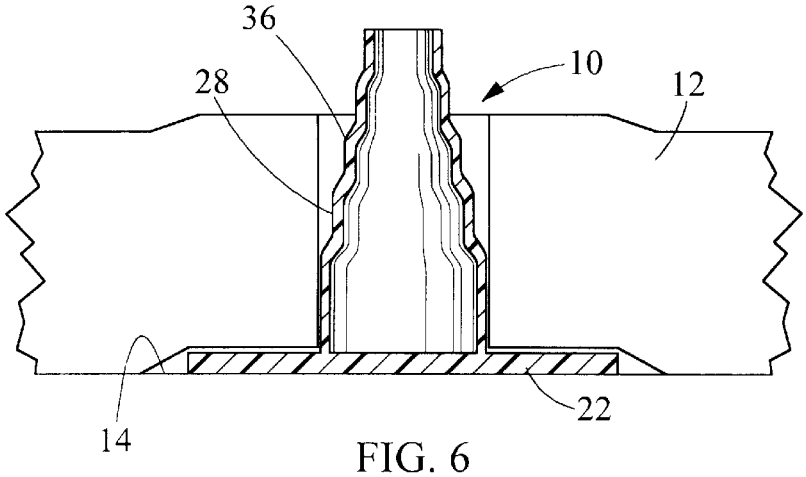
FIG. 6 is an elevational cross-section of the adjustable golf tee of FIG. 5 with the adjustable height portion shown in the extended position.

As discussed above, FIGS. 3–6 illustrate second and third embodiments of the adjustable height portion 32. The embodiments illustrated in FIGS. 3–6 would have to be manufactured from a more pliant material such as natural rubber, synthetic rubber or suitable thermoplastics in order to maintain their integrity with multiple extensions and contractions of the adjustable heights portions 34, 36 over wide ranges of temperatures from below freezing to in excess of 100° F. The embodiments illustrated in FIGS. 3–6 have the many advantages discussed above with regard to the embodiments shown in FIGS. 1 and 2, and have a further advantage of being infinitely adjustable between the compacted positions (see FIGS. 3 and 5) and their extended positions (see FIGS. 4 and 6). In the second embodiment of FIGS. 3 and 4, an adhesive, heat staking or some similar binding method may be employed to maintain the fold, as illustrated in FIG. 4.

FIGS. 7–10 illustrate alternative embodiments of the adjustable height golf tee of FIG. 1. In the embodiment illustrated in FIG. 7, the base 22, the tube 28 and the ball support 38 are three distinct pieces. The base 22 in this embodiment is preferably made up of an inexpensive, semi-rigid material in order to adequately secure the adjustable height golf tee 10 in the aperture 20 defined in the driving range mat 12. In a preferred embodiment, the base can be comprised of any suitable plastic material. The tube 28 is preferably made of a plastic such as polypropylene or the like, as discussed above with regard to the embodiment illustrated in FIGS. 1 and 2. The ball support 38 is made of a compliant, flexible, energy dissipating material such as natural or artificial rubber. In this manner, the ball support 38 keeps an extreme load, such as contact by a golf club, from being fully transformed to the more fragile tube 28. In an alternative embodiment, the ball support 38 could be a conventional golf tee made of wood or plastic frictionally engaged in the open end of the tube 28. In such an embodiment, the striking of the tee with a golf club would expel the tee, thereby dissipating energy transfer to the tube 28. Whatever material is used for the ball support 38, it is important that the material retain its compliant, energy dissipating properties in all temperature ranges for which the adjustable height golf tee 10 may be used, which would generally extend from below freezing to temperatures well in excess of 100° F.

Figure 7:
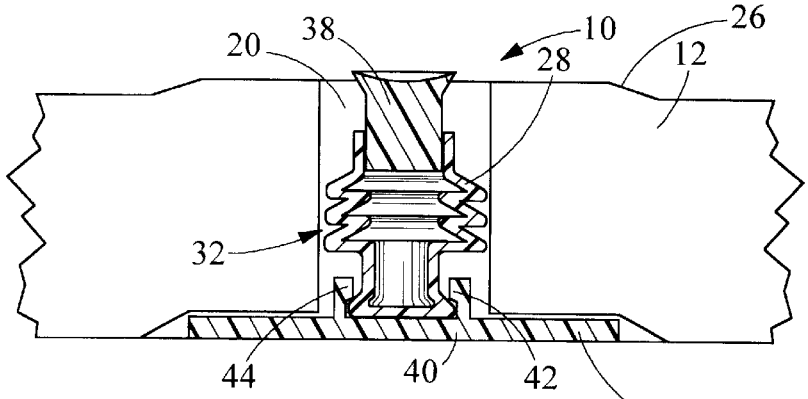
FIG. 7 is an elevational cross-section of an alternate embodiment of an adjustable golf tee of FIG. 1, having a distinct base, stem and ball support shown in a contracted position.

In the embodiment illustrated in FIG. 7, the ball support 38 is telescopingly received within the open end of the tube 28. The ball support is maintained in the distal open end of the tube 28 in any suitable manner, including a friction press fit, application of an adhesive, sonic welding, heat staking or the like.

The proximal end or base of the tube 28 includes an annular flange 40 which is press fit under a shoulder 42 defined in an arcuate collar 44 extending from the top surface 26 of the base 22. Alternatively, and as will be readily understood by those skilled in the art, the proximal end of the tube 28 can be secured to the base by adhesives, sonic welding, heat staking or the like.

Figure 8:
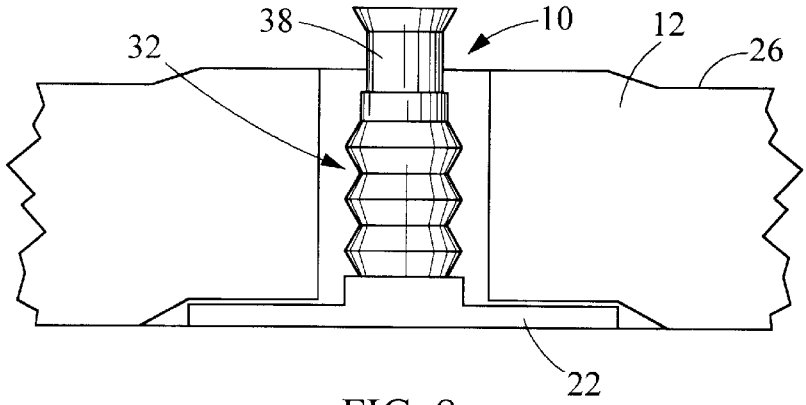
FIG. 8 is an elevational view of the adjustable golf tee of FIG. 7 in an extended position.

FIG. 8 illustrates that with the embodiment described in detail above with regard to FIG. 7, the ball support 38 alone would extend above the top surface 26 of the mat when the adjustable height portion 28 is fully extended. Thus, in the illustrated embodiment, the adjustable height portion 32, as well as the entire tube 28, would be protected from direct contact with a golf club during use.

Figure 9:
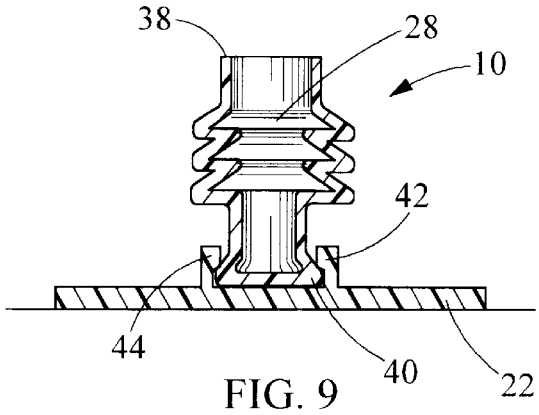
FIG. 9 is an elevational cross-section of an alternate embodiment of the adjustable height golf tee of FIG. 1, wherein the ball support is the distal end of the tube and the tube and base are separate pieces.

Yet another embodiment of the adjustable height golf tee is depicted in FIG. 9. In this embodiment, the ball support 38 is integrally formed of a single piece with the tube 28 and the base 22 is a separate piece made of the same or different material, as discussed above with respect to FIG. 7. The base 22 and the tube 28 can be attached in the same manner as discussed above with respect to FIG. 7.

Figure 10:
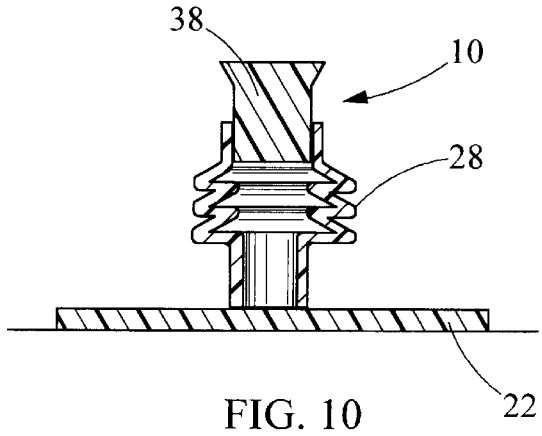
FIG. 10 is an elevational cross-section of an alternate embodiment of the adjustable golf tee of FIG. 1, wherein the base and tube are formed of a single piece and the ball support is a separate piece.

In FIG. 10, the base 22 and the tube 28 are integrally formed of a single piece, in the same manner and of the same material discussed above with reference to FIGS. 1 and 2. However, in this embodiment, the ball support 38 consists of a separate piece. The ball support 38 in FIG. 10 is preferably made of the same energy dissipating compliant material discussed above with reference to FIG. 7. Alternatively, and again as discussed with referenced to FIG. 7, the ball support 38 could be a conventional golf tee.

Figure 11:
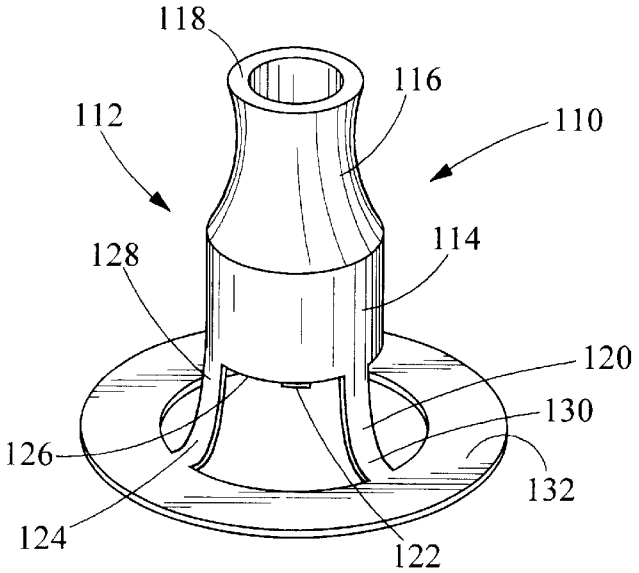
FIG. 11 is perspective view of another alternate embodiment of an adjustable height golf tee with a ball support shown in its extended position.

Yet another embodiment 110 of an adjustable height golf tee is depicted in FIG. 11. The adjustable height golf tee 110 consists of a ball support 112 having a cylindrical lower portion 114 and an upper portion 116 having a parabolic sidewall. At a distal end 118 of the ball support 112 is a ball supporting end which is simply the open end of the upper portion 116. The ball support 112 is hollow throughout its length. A plurality of ties 120, 122, 124 extend from the proximal end 126 of the ball support 112. The proximal end 128 of each tie is attached to the proximal end 126 of the ball support 112 and the distal end 130 of each tie is attached to a washer-shaped anchor 132. In FIG. 11 the adjustable height golf tee 110 is shown in its extended position.

The ball support viewed from the distal end has a select maximum footprint. The anchor viewed from the distal end of the ball support has a footprint which extends radially beyond that of the select maximum footprint of the ball support.

Figure 12:
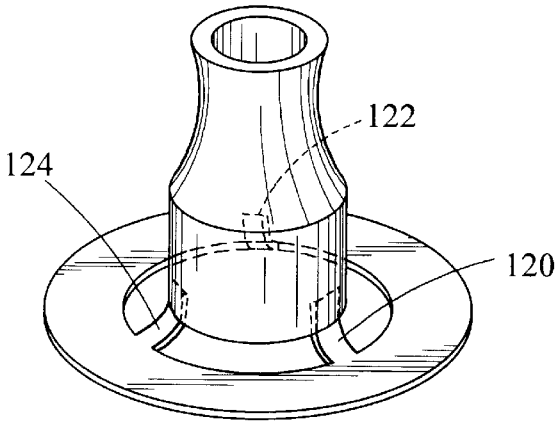
FIG. 12 is perspective view of the adjustable height golf tee of FIG. 11 shown in a reacted position.

In FIG. 12 the adjustable height golf tee is shown in its retracted position. As illustrated in FIG. 12, the ties 120, 122, 124 are configured to fold into the hollow interior of the ball support 112. This is accomplished by the ties 120, 122, 124 having a slight inward taper as best illustrated in the embodiment depicted in FIG. 13.

Figure 13:
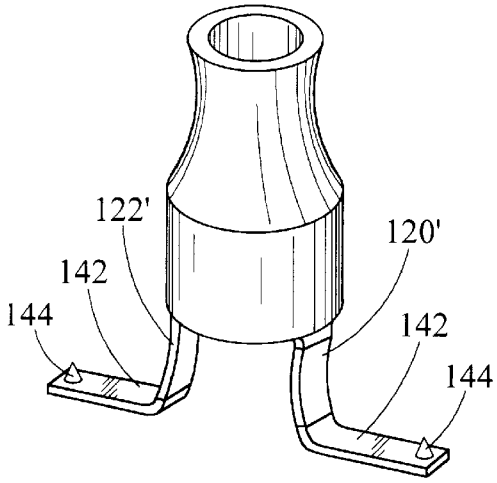
FIG. 13 is an alternate embodiment of the adjustable height golf tee of FIG. 11 shown in its extended position.

FIG. 13 is an alternate embodiment of the adjustable height golf tee 110 of FIG. 11. In this embodiment, only two ties are provided and instead of the washer-shaped anchor 132, a foot 142 extends from the distal end of each tie 120', 122'. At the distal end of each foot is an upwardly extending spike 144 for anchoring the foot in the underside of the driving range mat. Alternatively, the spike 144 may be eliminated. In all other manners the embodiment of FIG. 13 is identical to that of FIG. 11.

Figure 14:
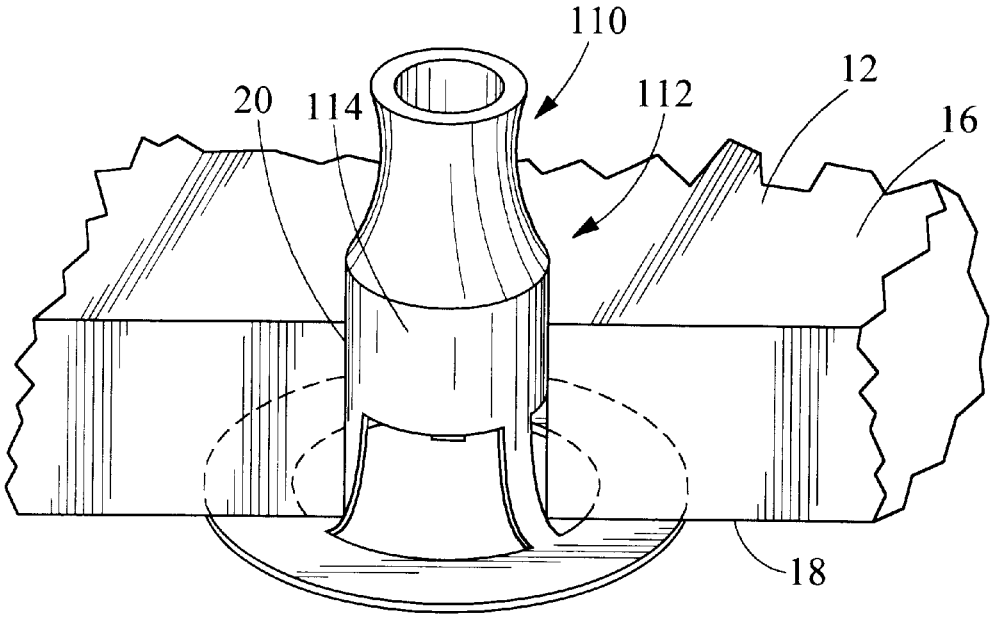
FIG. 14 depicts the adjustable height golf tee of FIG. 11 in combination with the driving range mat, with the adjustable height golf tee in its extended position.
Figure 15:
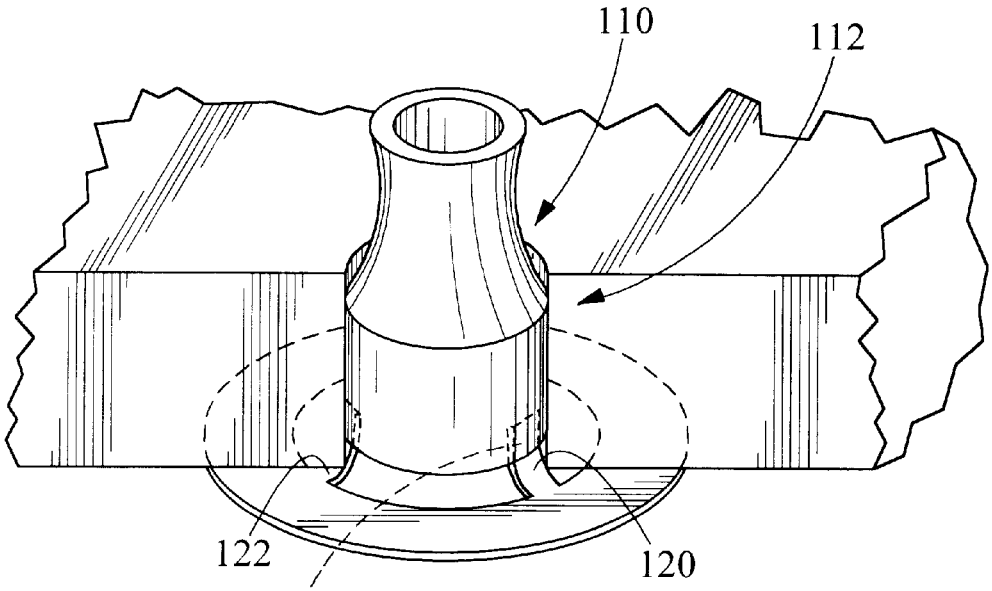
FIG. 15 is a perspective view of the adjustable height tee of FIG. 11 in combination with the driving range mat, with the adjustable height golf tee in its retracted position.

FIG. 14 shows the adjustable height golf tee 110 in combination with a driving range mat 12 described above with reference to FIG. 1. The outer diameter of the lower portion 114 of the adjustable height golf tee is slightly larger than the diameter of the aperture 20. In this manner, there is an interference fit between the lower portion 114 of the adjustable height golf tee 110 and the interior of the aperture 20. By virtue of this interference fit, the tee can be adjusted to elevate a ball above the upper surface 16 of the mat 12 any select height between the fully extended height depicted in FIG. 14 and the fully retracted height depicted in FIG. 15. Again, with reference to FIG. 15, with the adjustable height tee 110 in a contracted position, the ties 120, 122, 124 fold within the hollow interior of the ball support 112 so as to not interfere with the raising and lowering of the ball support 112.

The ball support tee of present invention, particularly the embodiment illustrated in FIGS. 11–15 can be inexpensively manufactured from a single piece of an elastomer at a minimal cost, yet provides a simple and highly reliable adjustable height golf tee for use with a driving range mat. The tee may be compression molded or injection molded of rubber, polypropylene, EPDM or other suitable polymers.

What is claimed is:

1. An adjustable height golf tee in combination with a driving range mat, the mat having a top and a bottom surface separated by a select depth, the mat further having an aperture of a select equivalent diameter extending between the top and bottom surfaces, the adjustable height golf tee comprising:

an elongate ball support having an external surface with a cross-section configured and dimensioned to form an interference fit with the mat aperture, whereby the ball support is extendable and retractable relative to the top surface of the mat and maintained at a select extended position by the interference fit;

an anchor adjacent the bottom surface of the mat fixed against withdrawal through the aperture of the mat; and a collapsible tie attached at a proximal end to the ball support and at a distal end to the anchor.

2. The adjustable height golf tee of claim 1 wherein the collapsible tie is of a length preventing withdrawal of the ball support through the aperture from the top surface of the mat.

3. The adjustable height golf tee of claim 1 wherein the anchor comprises a spike extending from the distal end of the tie into the bottom surface of the mat.

4. The adjustable height golf tee of claim 1 wherein the anchor comprises a ring having a equivalent diameter greater than the select equivalent diameter of the mat aperture to prevent withdrawal of the anchor through the mat aperture.

5. The adjustable height golf tee of claim 1 comprising a plurality of ties between the support and the anchor.

6. The adjustable height golf tee of claim 1 wherein the support comprises a first lengthwise section received in the aperture having the external lengthwise surface with a cross-section configured and dimensioned to form an interference fit with the mat aperture and a second lengthwise section extending from the first lengthwise section above the top surface of the mat, the second lengthwise section having a parabolic side wall between the first lengthwise section and a ball engaging end.

7. The adjustable height golf tee of claim 6 wherein the first lengthwise section includes a hollow interior and the collapsible tie is configured to fold into the hollow interior as the ball support is retracted relative to the top surface of the mat.

8. The adjustable height golf tee of claim 1 wherein the ball support, anchor and collapsible tie are integrally formed from a single piece of an elastomer.

9. An adjustable height golf tee comprising:

an elongate ball support having a side wall defining a hollow interior and a proximal end and a distal end, the distal end defining a ball support end; and a plurality of collapsible ties having a proximal end and a distal end with the proximal end attached to and extending from the proximal end of the ball support, the collapsible ties being configured to support the ball support in an upright orientation with the distal ends of the ties engaging a horizontal surface and to collapse into the hollow interior of the ball support upon application of only a select axial load to the ball support in a direction toward the proximal end of the ball support.

10. The adjustable height golf tee of claim 9 wherein the ball support viewed from the distal end has a select maximum foot print, the adjustable height golf tee further comprising an anchor attached to the distal ends of the ties, the anchor, viewed from the distal end of the ball support, having a footprint extending radially beyond that of the select maximum footprint of the ball support.

11. The adjustable height golf tee of claim 9 wherein the support comprises a first cylindrical lengthwise section at the proximal end and a second lengthwise section extending from the first lengthwise section to the distal end, the second lengthwise section having a parabolic side wall between the first lengthwise section and the ball support end.

12. The adjustable height golf tee of claim 11 comprising three equally radially spaced collapsible ties attached at their distal ends to a circular anchor having a diameter greater than the diameter of the first cylindrical section.

13. The adjustable height golf tee of claim 9 wherein the ball support and plurality of ties are integrally formed of a single piece of elastomer.

* * * * *